US008814395B1

(12) United States Patent
Schmitt et al.

(10) Patent No.: US 8,814,395 B1
(45) Date of Patent: Aug. 26, 2014

(54) SOLID STATE LIGHTING DEVICE WITH EXTENSIBLE MOUNTING BASE

(71) Applicants: Robert Schmitt, Nottingham, NH (US); Anil Jeswani, Beverly, MA (US)

(72) Inventors: Robert Schmitt, Nottingham, NH (US); Anil Jeswani, Beverly, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 0 days.

(21) Appl. No.: 13/784,986

(22) Filed: Mar. 5, 2013

(51) Int. Cl.
*F21V 21/22* (2006.01)
*F21V 21/14* (2006.01)

(52) U.S. Cl.
CPC ..... *F21V 21/14* (2013.01)
USPC ..... 362/371; 362/368; 362/650

(58) Field of Classification Search
CPC ..... F21S 8/04; F21S 8/026; F21V 21/04; F21V 19/001; F21V 23/06; F21V 19/02; F21V 21/14; F21V 21/22; H01R 33/00; H01R 33/2222
USPC ..... 362/640, 647, 652, 655, 657, 364–366, 362/368, 370, 371, 418, 430, 431, 649, 650
See application file for complete search history.

(56) References Cited

U.S. PATENT DOCUMENTS

| | | | | |
|---|---|---|---|---|
| 4,327,402 | A * | 4/1982 | Aubrey | 362/288 |
| 4,405,877 | A | 9/1983 | Haraden et al. | |
| 5,303,124 | A | 4/1994 | Wrobel | |
| 6,764,204 | B1 * | 7/2004 | Peters | 362/429 |
| 7,478,918 | B2 | 1/2009 | Petzl et al. | |
| 7,540,761 | B2 | 6/2009 | Weber et al. | |
| 8,147,267 | B2 | 4/2012 | Oster | |
| 2006/0013009 | A1 * | 1/2006 | Falco | 362/418 |
| 2011/0075423 | A1 * | 3/2011 | Van De Ven | 362/249.02 |
| 2012/0236580 | A1 * | 9/2012 | Cheng et al. | 362/387 |
| 2012/0300460 | A1 | 11/2012 | Liu et al. | |
| 2013/0265764 | A1 * | 10/2013 | Holman et al. | 362/249.02 |

* cited by examiner

*Primary Examiner* — Thomas M Sember
(74) *Attorney, Agent, or Firm* — Shaun P. Montana; William H. McNeill

(57) ABSTRACT

A solid state lighting device with an extensible mounting base is provided. The solid state lighting device includes a housing and a moveable extension positioned in the housing. The moveable extension is aligned along a longitudinal axis of the solid state lighting device, and includes a closed position adjacent the housing and an open position remote from the housing. A base is affixed to an external end of the moveable extension. The base connects to a corresponding socket in order to provide electrical power to the solid state lighting device. The housing also includes a mechanical actuator therein. The mechanical actuator has a first end, affixed to the moveable extension, and a second end, affixed to the housing. The mechanical actuator allows the moveable extension to change from the closed position to the open position and vice versa.

11 Claims, 6 Drawing Sheets

SOLID STATE LIGHTING DEVICE WITH EXTENSIBLE MOUNTING BASE

TECHNICAL FIELD

The present invention relates to lighting, and more specifically, to recessed luminaires.

BACKGROUND

An increasing number of solid state light source devices (e.g., lamps, luminaires) are being developed for recessed fixtures or housings. These devices typically have a relatively large body that must be encompassed within the fixture or the housing. For five and six inch versions, these devices may be "hard-wired" into the fixture or the housing. That is, a socket within the fixture/housing receives a screw base with connecting wires that protrude therefrom and include a small connector. The connector is plugged into the device and the device is then inserted into the fixture or the housing. The mechanical attachment of the device to the fixture is achieved by the use of torsion springs, springs clips, or combinations thereof, located on the device or attached thereto. The inside of the fixture/housing sometimes includes torsion spring brackets, particularly for five and six inch diameter versions, but not commonly found in four and three inch diameter versions.

SUMMARY

Large variations in the diameters of fixtures and/or housings, and large variations in the height of brackets, if any, make compatibility between a solid state light source device and the fixture/housing potentially problematic. Providing a variety of adjustability features on the device, to allow insertion of the device into multiple types and kinds of fixtures/housings, may make installation by a customer more difficult, and also increases cost. Further, the presence of additional metal clips and/or brackets, whether usable in a certain fixture/housing or not, may contribute to increased electromagnetic interference (EMI), which can adversely affect performance of the device.

Embodiments of the present invention provide a moveable extension with a base connected thereto. The base attaches to a corresponding socket. A mechanical actuator allows the moveable extension to change between a closed position and an open position, and vice versa. A solid state lighting device equipped with the moveable extension is easily installed in a fixture/housing with a socket. The moveable extension is temporarily put into its open position, and the base is attached to the socket. The moveable extension is then put into its closed position, by applying a force to the device. The mechanical actuator pulls the device into the fixture/housing, allowing for easy installation in a fixture/housing of any size or type, regardless of whether the fixture/housing includes mechanical connectors for the device or not.

In an embodiment, there is provided a solid state lighting device. The solid state lighting device includes: a housing; a moveable extension positioned in the housing, the moveable extension being aligned along a longitudinal axis of the solid state lighting device, wherein the moveable extension includes a closed position adjacent the housing and an open position remote from the housing; a base affixed to an external end of the moveable extension, wherein the base connects to a corresponding socket in order to provide electrical power to the solid state lighting device; and a mechanical actuator within the housing, wherein the mechanical actuator has a first end, affixed to the moveable extension, and a second end, affixed to the housing, wherein the mechanical actuator allows the moveable extension to change from the closed position to the open position and vice versa.

In a related embodiment, the mechanical actuator may be a spring. In another related embodiment, the mechanical actuator may be a ratcheting mechanism. In yet another related embodiment, the housing may include a stop configured to temporarily maintain the moveable extension in the open position. In a further related embodiment, the stop may be configured so as to be overcome by pressure applied to the solid state lighting device along the longitudinal axis. In another further related embodiment, the stop may include a protuberance formed on the moveable extension and a groove formed within a top of the housing. In a further related embodiment, the base may be capable of limited rotational movement along the longitudinal axis and the moveable extension.

In still another related embodiment, the housing may include a first housing and a second housing connected to the first housing, and the second housing may include, at least in part, the moveable extension and the mechanical actuator. In a further related embodiment, the second housing may include a stop configured to temporarily maintain the moveable extension in the open position. In a further related embodiment, the stop may be configured so as to be overcome by pressure applied to the solid state lighting device along the longitudinal axis. In another further related embodiment, the stop may include a protuberance formed on the moveable extension and a groove formed within a top of the second housing.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
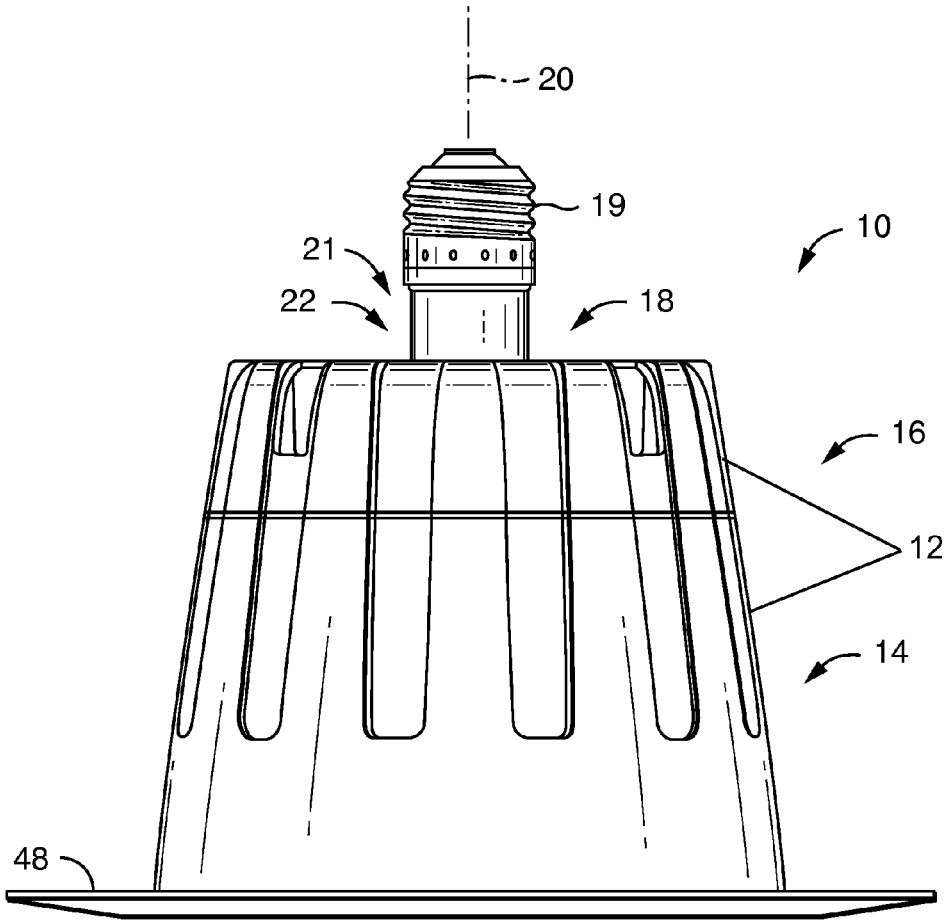
FIG. 1 shows a spring-loaded rotary mounting socket in a first position according to embodiments disclosed herein.

For purposes of this application, it is to be understood that when an element or layer is referred to as being "on," connected to" or "coupled to" another element or layer, it can be directly on, connected to or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. The term "and/or" includes any and all combinations of one or more of the associated listed items.

Although the terms "first," "second," "third" etc. may be used to describe various elements, components, regions, layers and/or sections, these elements, components, regions, layers and/or sections are not to be limited by theses terms as they are used only to distinguish one element, component, region, layer or section from another element, component, region, layer or section. Thus, a first element, component, region, layer or section could be termed a second element, component, region, layer or section without departing from the scope and teachings of the present invention.

Spatially relative terms, such as "beneath," below," upper," "lower," "above" and the like may be used herein for ease of description to describe one element or feature's relationship to another element(s) or feature(s) as illustrated in the drawings. These spatially relative terms are intended to encompass different orientations of the device in use or operation in addition to the orientation shown in the drawings. For example, if the device in the drawings is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Though embodiments are described throughout with reference to a recessed luminaire, of course the invention is not so limited and is, in some embodiments, made and used in the same way as described throughout for use with a solid state light source-based lamp (e.g., A19, B10, B12, BR20, BR30, PAR20, PAR30, PAR38, PAR40, etc.) that is meant to replace a traditional incandescent, halogen, and/or compact fluorescent lamp.

Figure 2:
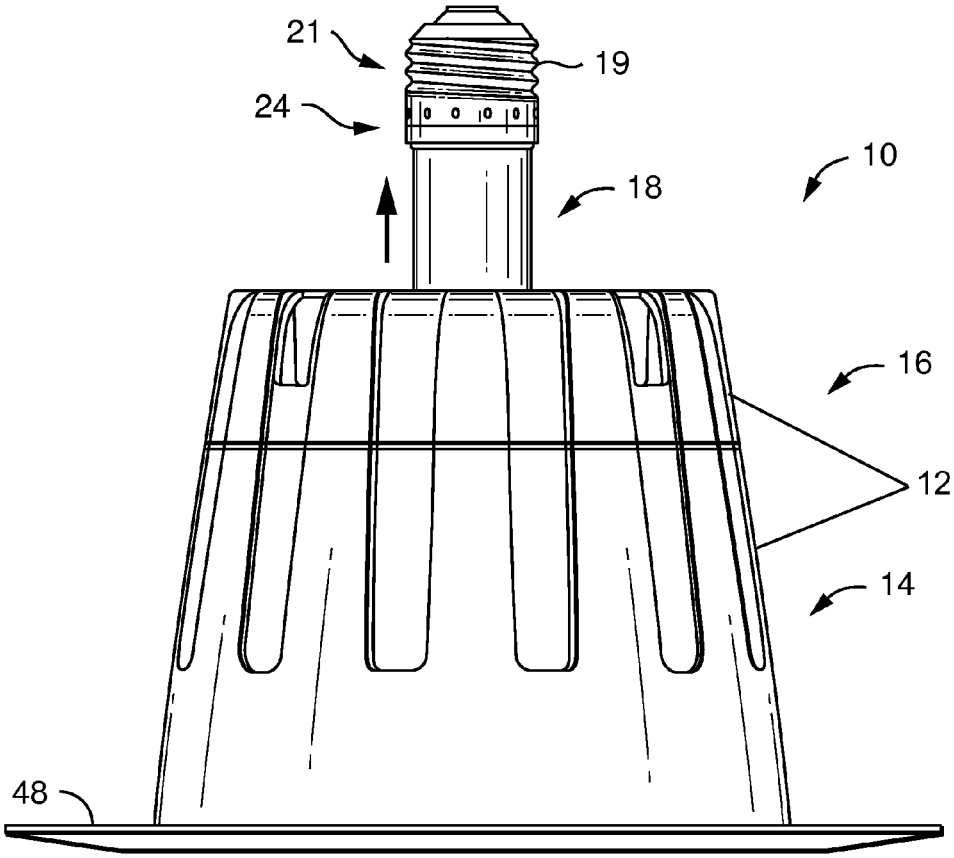
FIG. 2 shows a spring-loaded rotary mounting socket in a second position according to embodiments disclosed herein.
Figure 3:
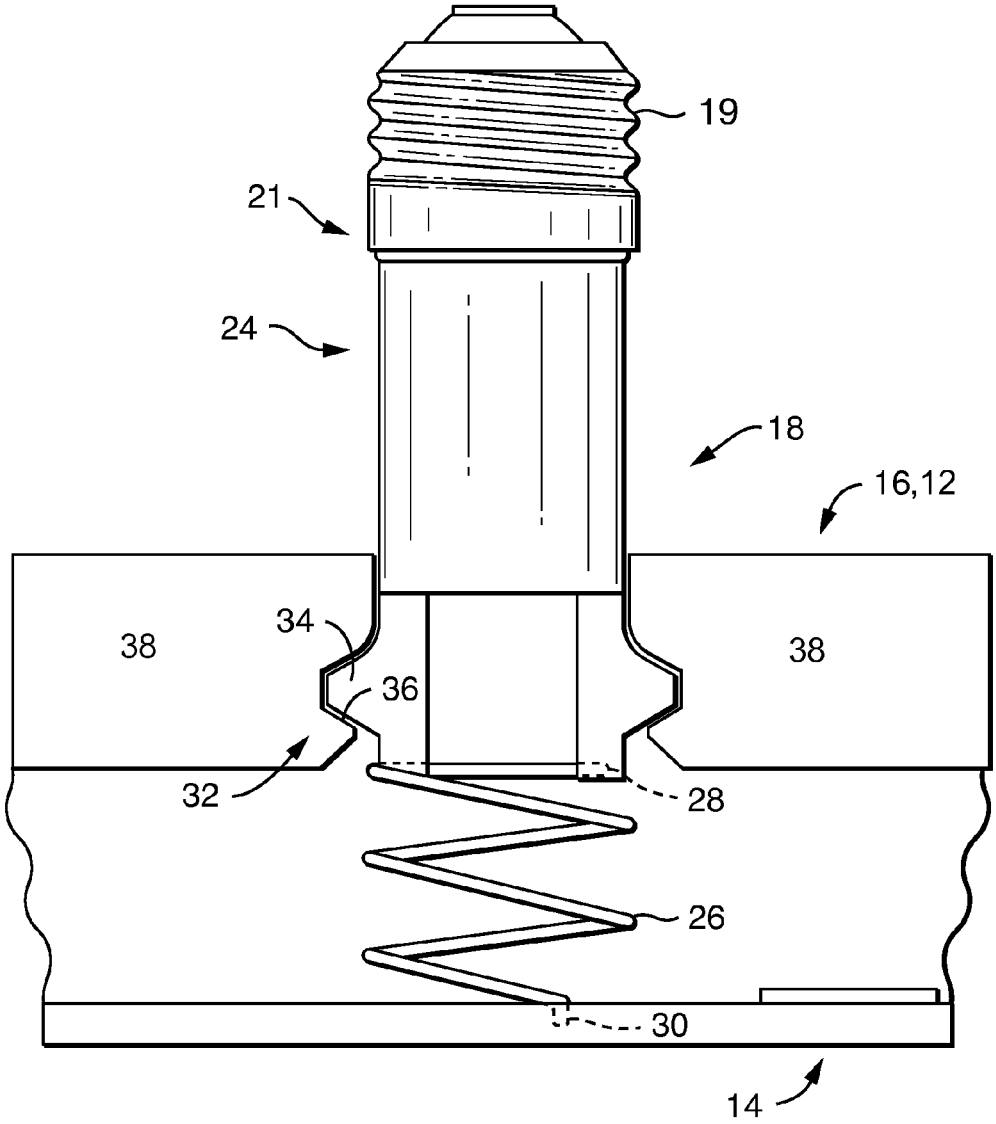
FIG. 3 is an enlarged view of a locking mechanism for use with a spring-loaded rotary mounting socket according to embodiments disclosed herein.
Figure 4:
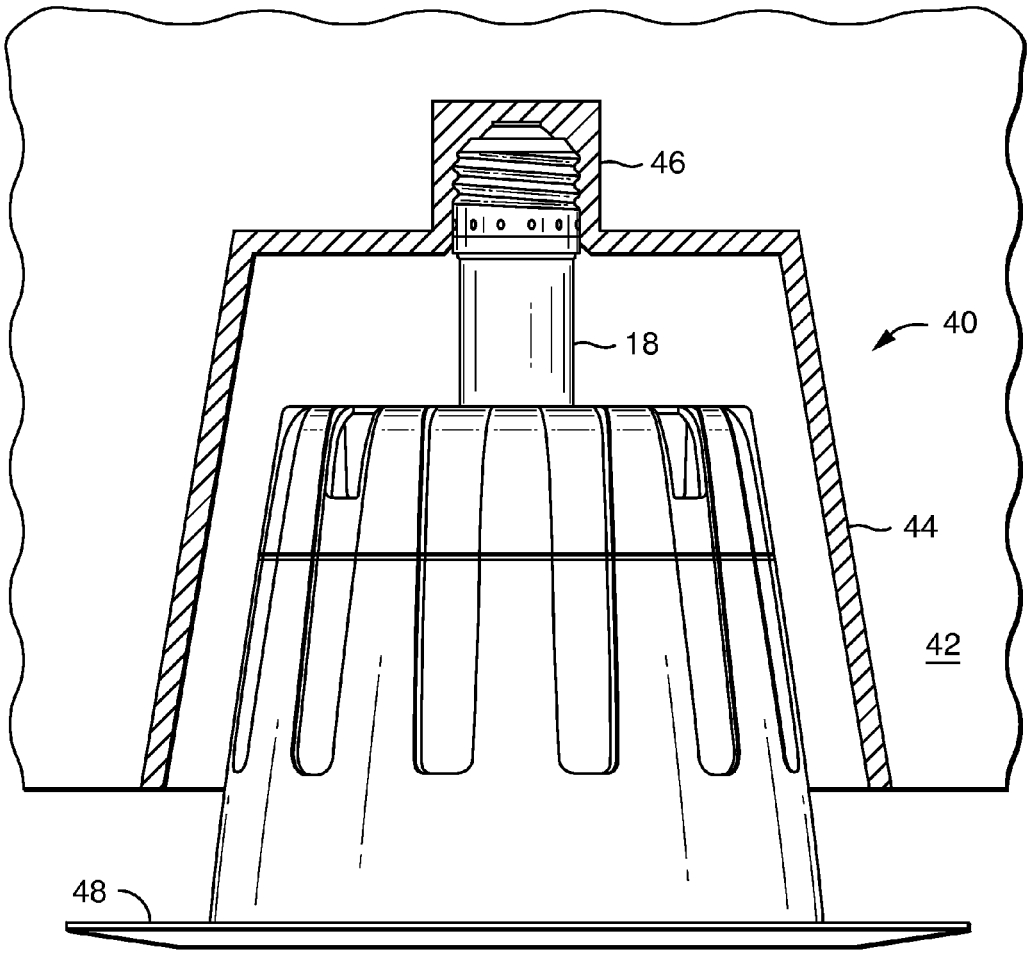
FIG. 4 is a partial section view of a stage in the placement of solid state light source device having a spring-loaded rotary mounting socket according to embodiments disclosed herein.
Figure 5:
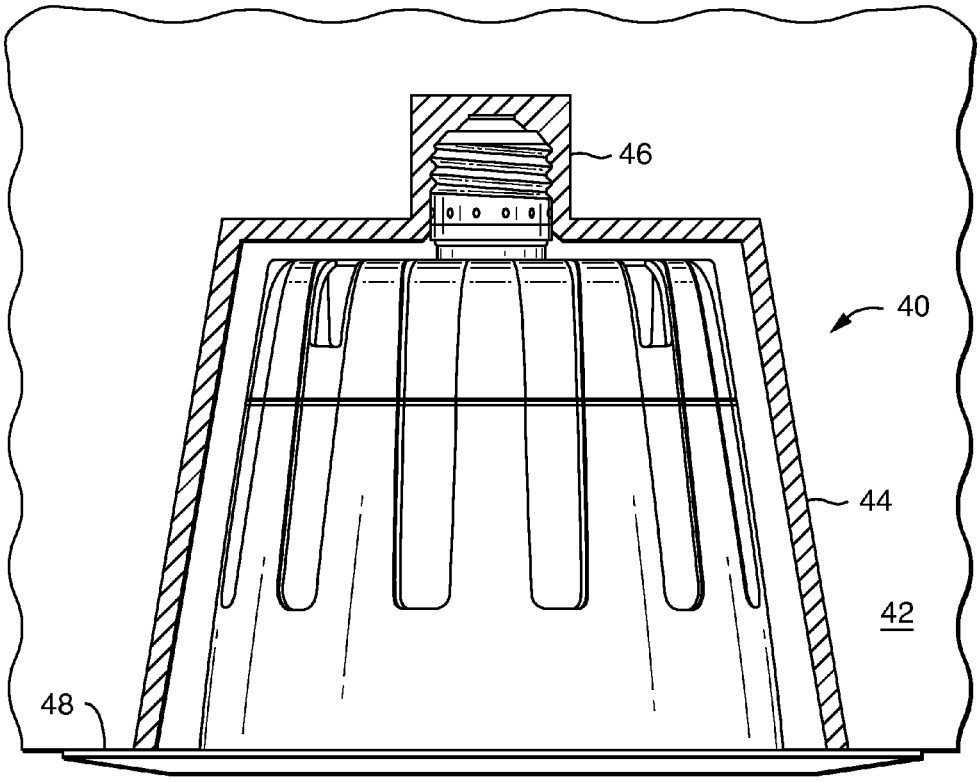
FIG. 5 is a partial section view of another stage in the placement of solid state light source device having a spring-loaded rotary mounting socket according to embodiments disclosed herein.
Figure 6:
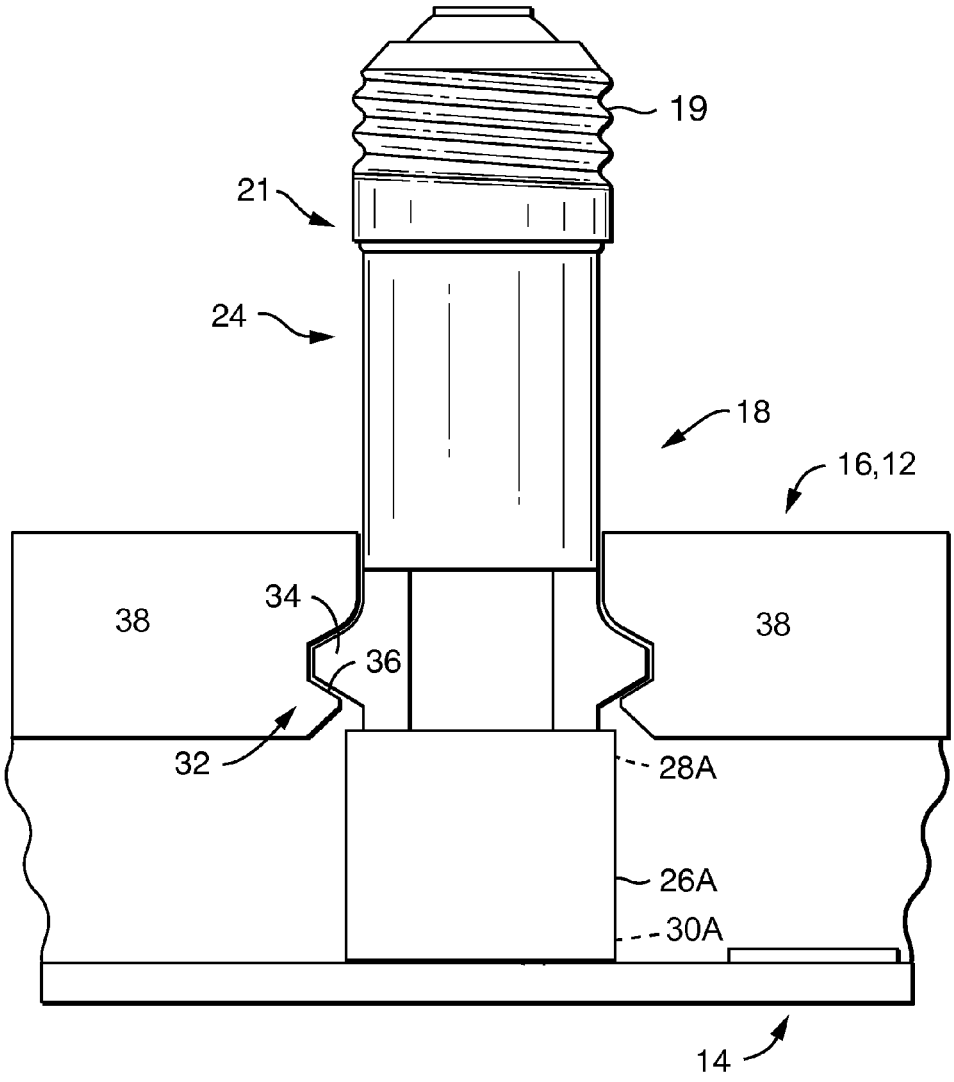
FIG. 6 is an enlarged view of a portion of an interior of a housing of a lighting device including a ratcheting mechanism according to embodiments disclosed herein.

FIG. 1 shows a recessed luminaire 10 having a housing 12. In some embodiments, the housing 12 includes a first housing 14 and a second housing 16 connected thereto. In some embodiments, the recessed luminaire 10 includes one or more solid state light sources (not shown). The first housing 14 may be, and in some embodiments is, made from any suitable material that transmits heat, such as but not limited to aluminum. The second housing 16 may be, and in some embodiments is, made from any suitable material that is electrically insulating, such as but not limited to a heat and/or fire resistant plastic. In some embodiments, the housing 12 is made from the same material. In some embodiments, the housing 12 is made from a variety of materials. A moveable extension 18 is positioned within the housing 12, and in some embodiments within the second housing 16, and is aligned along a longitudinal axis 20 of the recessed luminaire 10. The moveable extension 18 has a closed position 22 (as shown particularly in FIGS. 1 and 5) adjacent the housing 12, an in some embodiments the second housing 16, and an open position 24 remote from the housing 12, and in some embodiments, the second housing 16 (as shown particularly in FIGS. 2, 3, and 4). As seen in FIG. 3, in some embodiments a mechanical actuator, such as but not limited to a spring 26, is contained within the housing 12, and in some embodiments, the second housing 16. The spring 26 includes one end 28 and another end 30. The spring 26 is affixed at the one end 28 to the moveable extension 18 and at the another end 30 to the housing 12, and in some embodiments, to the second housing 16. The spring 26 acts to return the moveable extension 18 from the closed position 22 to the open position 24 and vice versa, when (for example) the recessed luminaire 10 is taken out of, or put into, a can 44 of a fixture 40 (as shown in FIGS. 4 and 5). In some embodiments, such as shown in FIG. 6, a different mechanical actuator, such as but not limited to a ratcheting mechanism 26A having one end 28A affixed to the movable extension 18 and another end 30A affixed to the housing 12, and in some embodiments, to the second housing 16, allows the moveable extension 18 to change between the closed position 22 and the open position 24, and vice versa. As shown in FIG. 3, a stop 32 within the housing 12, and in some embodiments the second housing 16, at least temporarily maintains the moveable extension 18 in the open position 24. In some embodiments, the stop 32 comprises a protuberance 34 formed on the moveable extension 18 and a groove 36 formed with a top 38 of the housing 12, and in some embodiments, the second housing 16.

A base 19 is affixed to an external end 21 of the moveable extension 18. The base 19, in some embodiments, is a typical Edison screw base as is well known in the art, though in other embodiments, other known bases (e.g., a bi-pin GU-style base, a multi-pin CFL-style base with or without posts, etc.) are used. The base 19 fits into a corresponding socket 46 within the fixture 40, as shown in FIGS. 4 and 5. The base 19 brings electrical power from the socket 46 to the recessed luminaire 10, allowing the solid state light source(s) within the luminaire 10 to operate to emit light. The fixture 40, which is typically mounted in a ceiling 42, includes the can 44 having the socket 46 at one end. Because the confines of the can 44 are relatively limited, installation of a lighting device (such as the recessed luminaire 10) within the can 44 may be problematic. The moveable extension 18 makes installation in the can 44 easier. The moveable extension 18 is pulled out of the housing 12, and in some embodiments the second housing 16, and put into its open position 24, by for example contacting the protuberance 34 with the groove 36 within the housing 12, and in some embodiments the second housing 16. The protuberance 34 and the groove 36 temporarily hold the moveable extension 18 in its open position 24, easily allowing a user to attach the base 19 of the moveable extension 18 of the recessed luminaire 10 to the corresponding socket 46 within the can 44. When the base 19 is fully engaged with the socket 46, the user applies pressure to, for example, a face of the recessed luminaire 10, in a direction along the longitudinal axis 20. The applied pressure overcomes the resistance of the protuberance 34 with the groove 36, allowing the spring 26 to pull the recessed luminaire 10 into the can 44. A rim 48 on the recessed luminaire 10 contacts the ceiling 42 (or other surface in which the recessed luminaire 10 is installed, for example but not limited to a portion of the fixture 40), providing a finished appearance and resistance to the pull force exhibited by the spring 26.

In some embodiments, the base 19 is formed so as to provide limited rotational movement about the longitudinal axis 20 and the moveable extension 18. Such a feature is shown in, for example, U.S. Pat. No. 4,405,877, issued Sep. 20, 1983.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A solid state lighting device, comprising:

a housing;

a moveable extension positioned in the housing, the moveable extension being aligned along a longitudinal axis of the solid state lighting device, wherein the moveable extension includes a closed position adjacent the housing and an open position remote from the housing;

a base affixed to an external end of the moveable extension, wherein the base connects to a corresponding socket in order to provide electrical power to the solid state lighting device; and a mechanical actuator within the housing, wherein the mechanical actuator has a first end, affixed to the moveable extension, and a second end, affixed to the housing, wherein the mechanical actuator allows the moveable extension to change from the closed position to the open position and vice versa.

2. The solid state lighting device of claim 1, wherein the mechanical actuator is a spring.

3. The solid state lighting device of claim 1, wherein the mechanical actuator is a ratcheting mechanism.

4. The solid state lighting device of claim 1, wherein the housing comprises a stop configured to temporarily maintain the moveable extension in the open position.

5. The solid state lighting device of claim 4, wherein the stop is configured so as to be overcome by pressure applied to the solid state lighting device along the longitudinal axis.

6. The solid state lighting device of claim 4, wherein the stop comprises a protuberance formed on the moveable extension and a groove formed within a top of the housing.

7. The solid state lighting device of claim 6, wherein the base is capable of limited rotational movement along the longitudinal axis and the moveable extension.

8. The solid state lighting device of claim 1, wherein the housing comprises:

a first housing; and a second housing connected to the first housing;

wherein the second housing includes, at least in part, the moveable extension and the mechanical actuator.

9. The solid state lighting device of claim 8, wherein the second housing comprises a stop configured to temporarily maintain the moveable extension in the open position.

10. The solid state lighting device of claim 9, wherein the stop is configured so as to be overcome by pressure applied to the solid state lighting device along the longitudinal axis.

11. The solid state lighting device of claim 9, wherein the stop comprises a protuberance formed on the moveable extension and a groove formed within a top of the second housing.

* * * * *